US006260710B1

(12) United States Patent
Deillon et al.

(10) Patent No.: US 6,260,710 B1
(45) Date of Patent: Jul. 17, 2001

(54) FLAT SIFTER

(75) Inventors: Marc-Leon Deillon, Speicher; Christoph Keller, Lustmühle, both of (CH)

(73) Assignee: Buhler AG, Uzwil (CH)

( * ) Notice: Subject to any disclaimer, the term of this patent is extended or adjusted under 35 U.S.C. 154(b) by 0 days.

(21) Appl. No.: 09/242,494

(22) PCT Filed: Jun. 4, 1997

(86) PCT No.: PCT/CH97/00227

§ 371 Date: Aug. 23, 1999

§ 102(e) Date: Aug. 23, 1999

(87) PCT Pub. No.: WO98/07529

PCT Pub. Date: Feb. 26, 1998

(30) Foreign Application Priority Data

Aug. 20, 1996 (CH) ..... 2042/96

(51) Int. Cl.[7] ..... B07B 1/49

(52) U.S. Cl. ..... 209/399; 209/315; 209/409

(58) Field of Search ..... 209/315, 405, 209/399, 403, 408, 409

(56) References Cited

U.S. PATENT DOCUMENTS

| | | | |
|---|---|---|---|
| 2,455,383 | | 12/1948 | Pickard . |
| 2,511,885 | | 6/1950 | Thompson . |
| 3,980,555 | | 9/1976 | Freissle . |
| 4,219,412 | | 8/1980 | Hassall . |
| 4,347,129 | | 8/1982 | Rutherford . |
| 4,383,919 | | 5/1983 | Schmidt . |
| 4,728,422 | | 3/1988 | Bailey . |
| 4,846,352 | * | 7/1989 | Bailey . |
| 4,950,403 | | 8/1990 | Hauff et al. . |
| 5,045,184 | | 9/1991 | Arkles . |
| 5,051,171 | | 9/1991 | Hukki . |
| 5,137,622 | | 8/1992 | Souter . |
| 5,266,194 | | 11/1993 | Chiodo . |

(List continued on next page.)

FOREIGN PATENT DOCUMENTS

| | | | |
|---|---|---|---|
| 359589 | | 11/1958 | (CH) . |
| 359589A | * | 2/1962 | (CH) . |
| 1507716 | | 7/1966 | (DE) . |
| 2256307 | | 7/1973 | (DE) . |
| 2459285 | * | 6/1976 | (DE) . |
| 2506981 | | 6/1976 | (DE) . |
| 2823623 | | 11/1979 | (DE) . |
| 3544752C1 | | 5/1987 | (DE) . |
| 3802799A1 | | 8/1989 | (DE) . |
| 0330846 | | 1/1989 | (EP) . |
| 491331 | | 6/1992 | (EP) . |
| 0584302 | | 2/1993 | (EP) . |
| 1503343 | | 3/1978 | (GB) . |
| WO 93/16815 | | 9/1993 | (WO) . |

OTHER PUBLICATIONS

English Translation of specification and claims of CH 359, 589.

International Search Report for PCT/CH 97/00227.

* cited by examiner

*Primary Examiner*—John Q. Nguyen
(74) *Attorney, Agent, or Firm*—Finnegan, Henderson, Farabow, Garrett & Dunner, L.L.P.

(57) ABSTRACT

A flat sifter with self-supporting structure which is preferably used for sifting grain and flour-like products in mills. The aim is to markedly simplify the construction and assembly of such a flat sifter while improving the sanitary conditions. That aim is achieved by combining one or several double compartments, which are mounted laterally adjacent to one another with a universal drive unit.

9 Claims, 3 Drawing Sheets

U.S. PATENT DOCUMENTS

| | | |
|---|---|---|
| 5,385,241 | 1/1995 | Bokor . |
| 5,385,669 | 1/1995 | Leone, Sr. . |
| 5,417,906 | 5/1995 | Chiodo . |
| 5,527,500 | 6/1996 | Specht . |
| 5,538,139 | 7/1996 | Keller . |
| 5,598,931 | 2/1997 | Hosogoshi et al. . |
| 5,664,686 | 9/1997 | Hosogoshi et al. . |
| 5,755,334 | 5/1998 | Wojcik et al. . |
| 5,819,952 | 10/1998 | Cook et al. . |
| 5,851,393 | 12/1998 | Carr et al. . |
| 6,006,923 | 12/1999 | Helmy et al. . |

FLAT SIFTER

FIELD OF INVENTION

The invention relates to a plan sifter, in particular a square plan sifter and its structure with respect to the supporting elements.

BACKGROUND OF THE INVENTION

Plan sifters of this type are used, in particular, for sifting scrap, semolina- and/or flour-like products in mill process engineering and for sorting various types of vegetable grain such as wheat, rye or maize and generally for separating granular material into different grain sizes.

Plan sifters, in particular large and square plan sifters, belong to the current state of the art, for example for separating and sieving/sifting or classifying ground cereal products.

Operation of a plan sifter is influenced by many factors, natural limits to performance being imposed, even in the best condition. The intensity of the vibrating movement (maximum acceleration) is also restricted both by the moving behaviour of the ground product and by the maximum permitted forces in the housing. Performance data are therefore determined according to the specific quality of the individual fractions.

A square plan sifter is known from WO 93/16815, which has a swinging drive which forces the plan sifter and all sieves to perform a rotating movement, the plan sifter usually being suspended as a whole on rods as a freely vibrating screen.

With these plan sifters, horizontally arranged sieves having different mesh widths are superimposed vertically to form stacks. The sieves are assembled in the form of stacks and are pushed into cupboard-like sieve housings and fixed. The sieve housings are usually arranged symmetrically on either side of an unbalanced drive. The sieve housings form a supporting construction with the base plate and continuous cross bars. The sieve housings are rigidly connected at their front faces to the interposed drive housing via a connecting support. The unbalanced drive can have an unbalanced mass which is connected to the drive shaft at a variable distance as a function of speed (EP-A-491331). According to DE-PS 2823623, the frame of such a plan sifter is designed as a supporting housing which receives and laterally supports the stack of sieves, with a housing base which forms a supporting base for the stack of sieves and on the upwardly directed lateral walls thereof. In a different form, a plan sifter according to DE-PS 2256307 has stack fixing devices which produce vertical forces, the forces of the vibration generator being transmitted via top and bottom elements of rigid stack frames which are resistant to vibration. The stack frames are characterised by two respective vertical elements which are each arranged in a plane containing the centre of gravity of the stack and at right angles to the longitudinal plane extending through the stack and the vibration generator and which are rigidly connected to the top and bottom elements of the stack frames. The vertical elements form the vertical edges of a square vibrating frame, the vibrating bearings of the plan sifter being arranged on these vertical elements.

Although such constructions can sometimes be modular in design, they are expensive to produce.

SUMMARY OF THE INVENTION

It is accordingly the object of the invention to design a generic plan sifter such that its production of the supporting structure is discernibly simplified by a further developed modular construction. Furthermore, the dead weight is simultaneously to be reduced and sanitation and accessibility improved within the limits imposed in terms of vibration.

Since the flow of force can be effected via the supporting structure, further possibilities for modularisation are afforded. The force flows more gently overall and a greater proportion of the flow of force can be conveyed via the stack of sieves in a manner which is beneficial to operation. A supporting structure of this type can obviously be compared with the state of the art according to DE-PS 2256307 only with respect to the basic elements of base, vertical supports and cover, but its detailed design is not obvious as it is not covered by the principles of vibration. In particular, the production and assembly of the parts of the supporting structure are simplified. The supporting structure of the plan sifter according to the invention consists of several double compartments which are connected to one another at the sides and are suspended by vertical supports at the ends.

The double compartments consist of a cover and a base, which are connected by vertical profiles and form two (respective) compartments (sieve compartment) with lateral parts. A separate frame construction for base and cover is or can be dispensed with.

The lateral parts are fastened positively and non-positively in the vertical profiles, the positive fastening ensuring tightness and therefore sanitation. Cold and warm bridges can be avoided by further insulation. An air duct in the vertical profiles can cause heating of the profile surface due to permeation with warm air from the cover, so condensation is avoided. Such an option may be worthwhile, in particular in the case of delicate products. The warm air stream can be prepared by removal from the product stream or also separately.

The stacks of sieves can then be inserted and fixed, preferably purely positively, in the supporting structure. These stacks of sieves can be fixed both conventionally and, in a further embodiment of the invention, using pneumatic means. An elastic, inflatable element which ensures defined, uniform vertical fixing when filled with air and at the same time has a sound-damping effect is arranged in the space between stacks of sieves and cover. In contrast to conventional fixing which is effected from the exterior, fixing can be carried out more simply and compactly from the interior.

In a further embodiment of the invention, the external lateral parts and also the doors consist of sandwich constructions or foamed elements, these sandwich elements being known as such but not such an application. The doors are preferably inserted and fixed positively and non-positively between two vertical profiles and are therefore easy to use.

BRIEF DESCRIPTION OF THE DRAWINGS

An embodiment of the invention is described in detail hereinafter with reference to drawings.

DESCRIPTION OF THE PREFERRED EMBODIMENT

Figure 1:
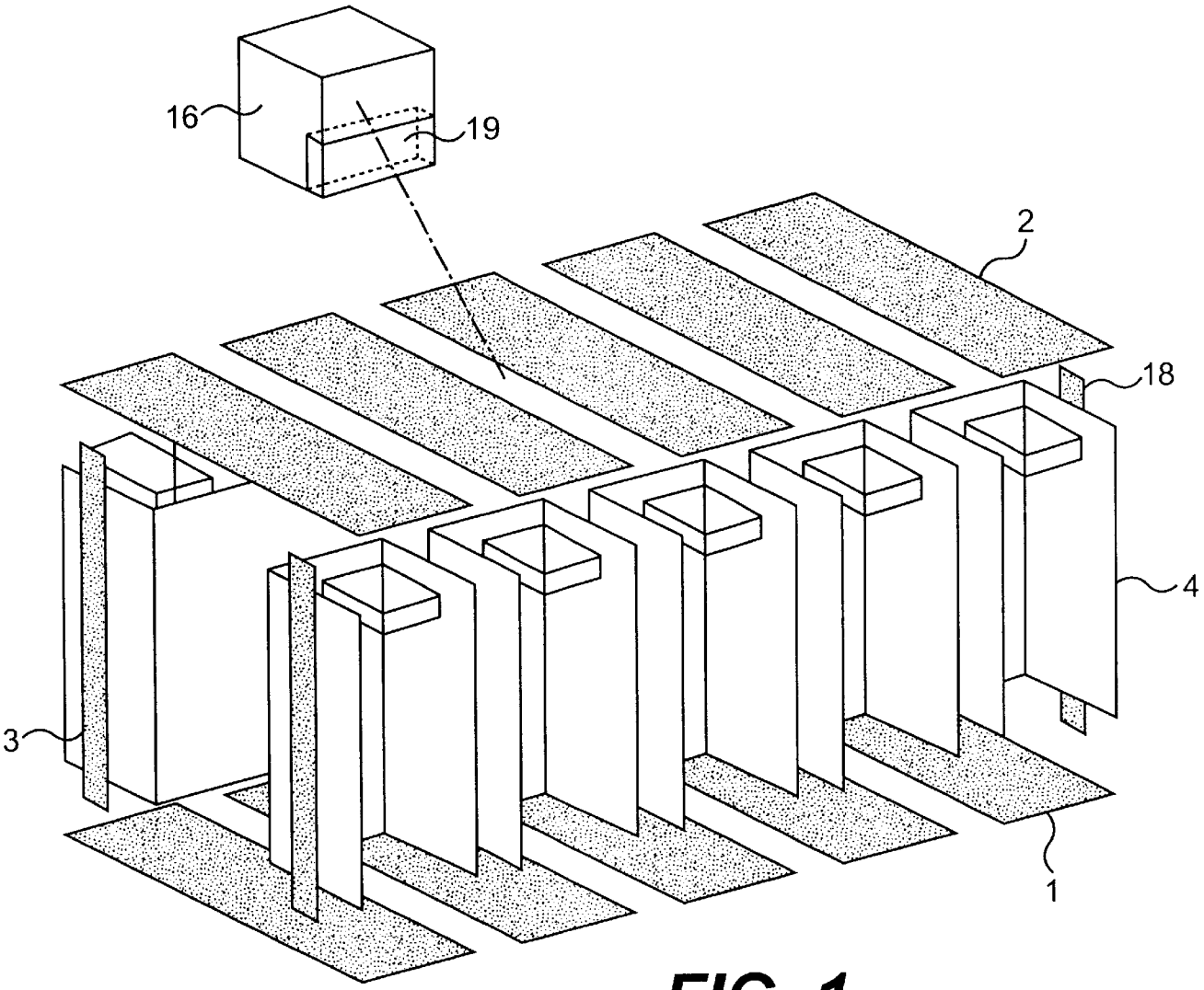
FIG. 1 is an exploded view of a plan sifter.
Figure 2:
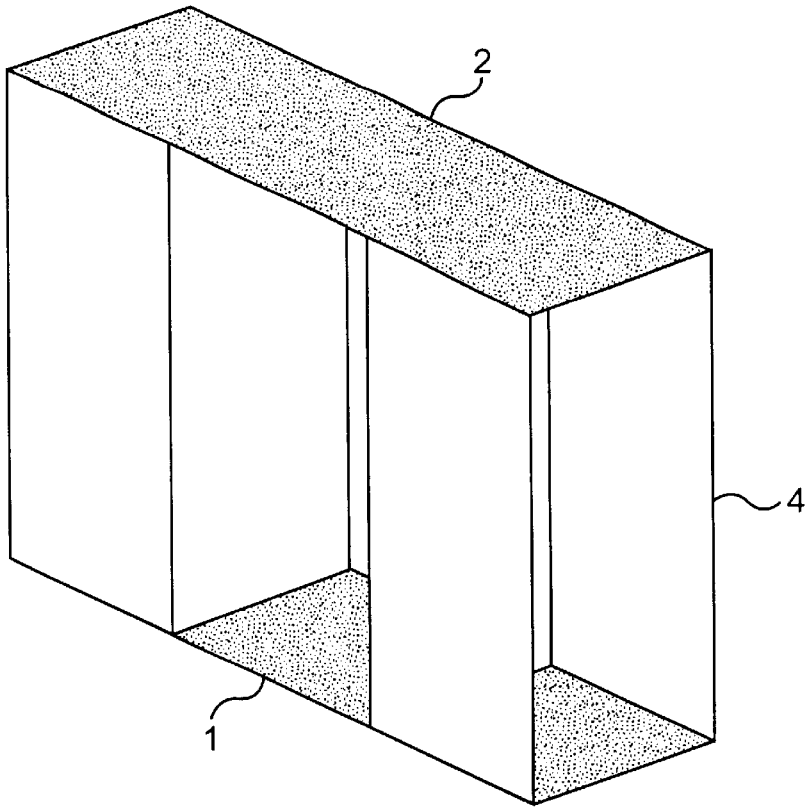
FIG. 2 shows a double compartment.
Figure 4:
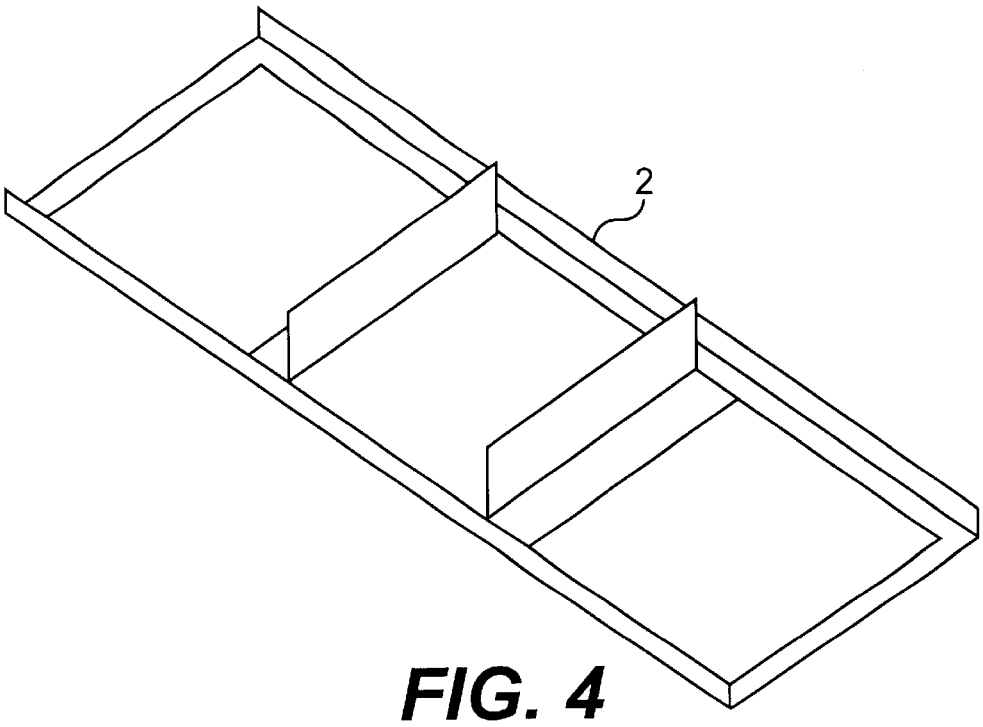
FIG. 4 shows a cover, as viewed from below.
Figure 3:
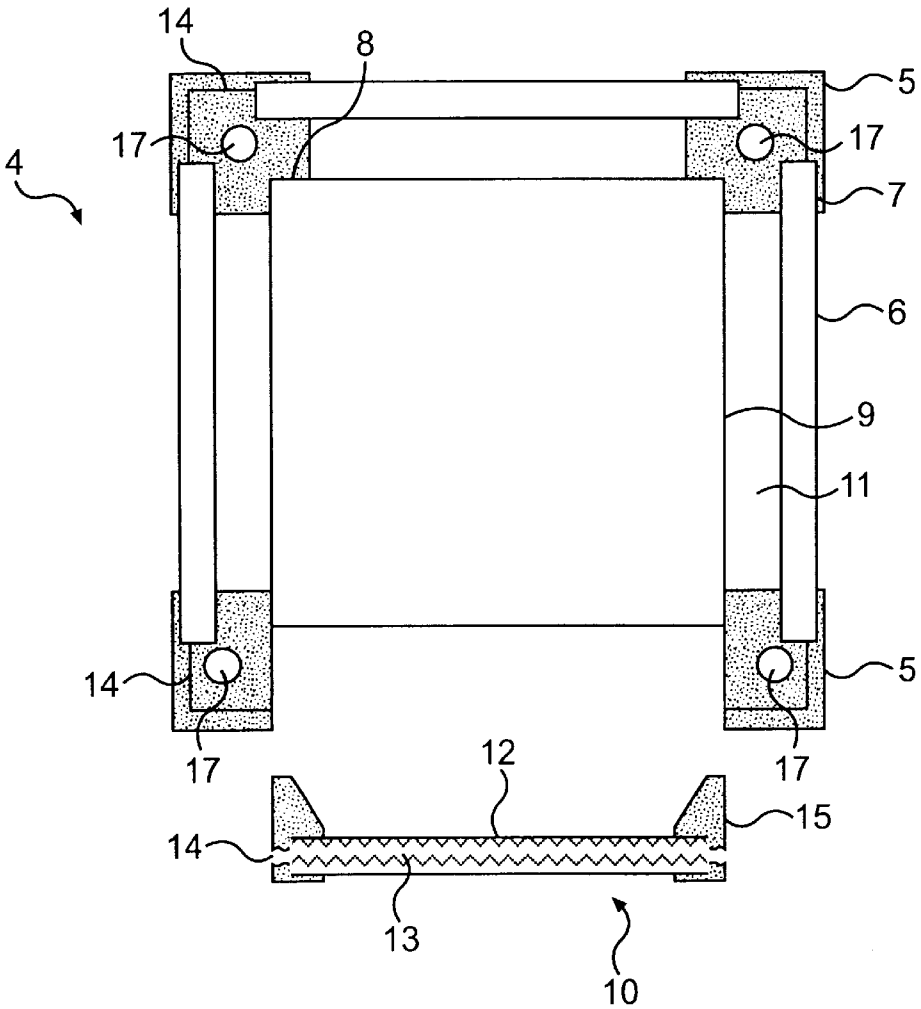
FIG. 3 is a sectional view of a compartment and a door.

Plan sifters of this type are operated in a suspended arrangement, but this is not shown in detail in the drawings. The unbalanced drive which is inserted laterally into the plan sifter as a separate module in contrast to the state of the art as an independent drive unit and is therefore connected to the double compartments is not shown in detail either.

The drive unit represents an unbalanced drive with resonant motor in order, via the drive, to set the double compartments and therefore the stacked sieves into a vibrating movement which is normal with such plan sifters.

As a square plan sifter, the plan sifter contains 5×2 stacks of sieves 9 in this embodiment, and similar arrangements of 1×2 stacks of sieves 9 can be made upwards. In this example, the supporting structure consists of five double compartments laterally connected to one another and of four vertical supports 3 arranged on the transverse sides. The double compartments themselves consist of a base 1 and a cover 2 which are connected by vertical profiles 5 and form two compartments 4 with lateral parts 6. The driving unit is arranged in the space between the double compartments while allowing for the number of double compartments. The lateral parts 6 with a foam sandwich construction are fitted into the vertical profiles 5 in indentations 7 in the vertical profiles 5. Sieves arranged in stacks of sieves 9 are inserted and fixed (braced) in further recesses 8 in the vertical profiles 5. Complete horizontal fixing (bracing) of the stacks of sieves 9 is guaranteed by the inserted doors 10 consisting of lateral parts 6 fitted in door profiles 15. Thus, the means for fixing (bracing) the sieves includes; the vertical profiles 5, the doors 10, and the lateral parts 6 fitted in door profiles 15. The lateral parts 6 consist of metal covering plates 12 (preferably aluminium) and an intermediate layer of foam 13. Insulators (polymeric liner) 14 in the vertical profiles 5 act as cold bridges. The lateral parts 6 are merely inserted into the indentations 7 and fixed and adhered using gauges.

The continuous cavities provided in the vertical profiles 5 optionally serve as an additional air duct for warm air and prevent condensation. The vertical profiles 5 themselves can consist of conventional commercial aluminium profiles.

The frame of the door 10 is similar in design to the vertical profiles 5, even with respect to the connection to the door leaf (similar lateral part 6).

The vertical profiles 5 themselves are connected to the base 1 and the cover 2 by screw connections so the necessary shape and strength is achieved and the force flows in the above-mentioned manner. Base 1 and cover 2 are laser-cut and bent into shape prior to coating.

Covering elements (not shown) can be fastened on the outer corner parts of the vertical profiles 5 to obtain flush, smooth external contours of the plan sifter. The same applies to the upper and lower lateral edges.

The lateral parts 6 can be coated with the necessary paint or the like, making further treatment before, during or after assembly unnecessary.

In the space between the cover 2 and the uppermost sieve of a stack of sieves 9, a flexible tubular element 18 is also optionally arranged substantially on the sieve frame to allow defined, vertical fixing (bracing) of the stack of sieves 9 when filled with air or other gases. A uniform, measurable fixing force is applied, and this also increases the reliability of operation.

A vibration generator can also be arranged according to DE-PS 2256307 and the sieving process will also take place in a similar manner. The drive is preferably preassembled as a module and is mounted separately, allowing transportation of a plan sifter to be carried out in modules and to be completed comparatively inexpensively on site. See schematic of modular drive unit 19 in FIG. 1.

Key to Reference Numerals

1 base
2 cover
3 vertical support
4 compartment
5 vertical profile
6 lateral part
7 indentation
8 recess
9 stack of sieves
10 door
11 space
12 covering plate
13 foam
14 insulation
15 door profile
16 vibration generator
17 air channels
18 flexible bracing elements
19 modular drive unit

What is claimed is:

1. A plansifter with vibration bearings having at least two sieve stacks, comprising:

a plurality of sieves arranged on top of one another, defining the sieve stacks;

a vibration generator symmetrically located between the plurality of sieves;

sieve compartments defined by the plurality of sieves, the compartments arranged to transmit the vibration to the at least two sieve stacks;

bracing means including doors for horizontally and vertically bracing the plurality of sieves, wherein each of the at least two sieve stacks is accommodated within four vertical profiles and is surrounded in a dust-proof manner on at least one side by a plurality of doors with profiles and on remaining sides by a plurality of lateral panels.

2. The plansifter according to claim 1, wherein the sieve compartments are configured as modular double compartments.

3. The plansifter according to claim 1, wherein the lateral panels comprise sandwich panels including metallic cover panels and a foam material intermediate layer.

4. The plansifter according to claim 1, further comprising insulation layers disposed along the vertical profiles and profiles of the doors, to prevent cold bridges and to connect the doors to the lateral panels.

5. The plansifter according to claim 1, further comprising continuous air channels disposed within each of the vertical profiles.

6. The plansifter according to claim 1, further comprising:

a plurality of covers disposed to close one end of corresponding sieve compartments; and a flexible, inflatable bracing element disposed between each of the at least two sieve stacks and corresponding covers, on an uppermost one of the plurality of sieves.

7. The plansifter according to claim 6, wherein the plurality of covers are rigid and further comprising a plurality of rigid bases disposed to close an opposite end of the corresponding sieve compartments.

8. The plansifter according to claim 1, wherein the vibration generator includes a separately installable modular drive unit.

9. The plansifter according to claim 1, wherein the sieve compartments are formed of a sandwich material having a soft core.

* * * * *